US009453438B2

(12) United States Patent
Ikuma et al.

(10) Patent No.: US 9,453,438 B2
(45) Date of Patent: Sep. 27, 2016

(54) VALVE TIMING ADJUSTING DEVICE

(71) Applicant: DENSO CORPORATION, Kariya, Aichi-pref. (JP)

(72) Inventors: Tomonobu Ikuma, Kariya (JP); Kinya Takahashi, Nishio (JP); Eiji Isobe, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/337,507

(22) Filed: Jul. 22, 2014

(65) Prior Publication Data

US 2015/0034032 A1 Feb. 5, 2015

(30) Foreign Application Priority Data

Jul. 31, 2013 (JP) ..... 2013-159070
Jun. 5, 2014 (JP) ..... 2014-116600

(51) Int. Cl.
*F01L 1/34* (2006.01)
*F01L 1/344* (2006.01)

(52) U.S. Cl.
CPC ..... *F01L 1/3442* (2013.01); *F01L 2001/3444* (2013.01); *F01L 2001/34426* (2013.01); *F01L 2001/34456* (2013.01)

(58) Field of Classification Search
CPC ..... F01L 1/3442; F01L 2001/3444; F01L 2001/34426; F01L 2001/34456
USPC ..... 123/90.15, 90.17
See application file for complete search history.

(56) References Cited

U.S. PATENT DOCUMENTS

2003/0084863 A1 5/2003 Golovatai-Schmidt et al.
2008/0173267 A1 7/2008 Takahashi et al.
2008/0264200 A1 10/2008 Hoppe et al.
2009/0078222 A1 3/2009 Murao et al.
2011/0259289 A1 10/2011 Fujiyoshi
2012/0097122 A1* 4/2012 Lichti
2013/0112163 A1 5/2013 Bayrakdar

OTHER PUBLICATIONS

Japanese Patent Office, "Notification of Reasons for Refusal," (3 pages) issued in connection with Japanese Patent Application No. 2014-116600, dated Aug. 4, 2015, with its English language Translation (4 pages).

* cited by examiner

*Primary Examiner* — Ching Chang
(74) *Attorney, Agent, or Firm* — Nixon & Vanderhye PC

(57) ABSTRACT

In a valve timing adjusting device, a vane rotor includes a second supply oil passage connectable to a first supply oil passage of a second shaft. A check valve is provided between the vane rotor and the second shaft, and permits a flow from the first supply oil passage toward the second supply oil passage and prevents a flow from the second supply oil passage toward the first supply oil passage. A fixing unit is provided between the check valve and the second shaft, and fixes the check valve between the fixing unit and the vane rotor. The fixing unit includes a third supply oil passage which connects the first supply oil passage and the second supply oil passage. A filter is provided for the fixing unit and can capture foreign substances flowing through the third supply oil passage.

13 Claims, 16 Drawing Sheets

VALVE TIMING ADJUSTING DEVICE

CROSS REFERENCE TO RELATED APPLICATION

This application is based on Japanese Patent Application No. 2013-159070 filed on Jul. 31, 2013, and Japanese Patent Application No. 2014-116600 filed on Jun. 5, 2014, the disclosures of which are incorporated herein by reference.

TECHNICAL FIELD

The present disclosure relates to a valve timing adjusting device.

BACKGROUND

There is known a valve timing adjusting device that can adjust valve timing of an intake valve and an exhaust valve of an engine. For example, a valve timing adjusting device in JP-A-2003-120231 includes a housing that can rotate integrally with a crankshaft, and a vane rotor that can rotate integrally with a cam shaft, and changes pressures of an advance chamber and a retard chamber in the housing to relatively rotate the vane rotor, thereby adjusting the valve timing. When the advance chamber and the retard chamber are not distinguished from each other, they are hereinafter referred to as an "oil pressure chamber".

Pressure control of the oil pressure chamber is performed by a direction switching valve provided for, for example, a cylinder head of the engine. This direction switching valve supplies operating oil, which has been pressure-fed from an oil pump, into the oil pressure chamber through an oil passage of the cylinder head and an oil passage of the cam shaft. In JP-A-2003-120231, a filter is provided between the oil pump and the direction switching valve. Foreign substances contained in the operating oil pressure-fed from the oil pump are captured by this filter.

In JP-A-2003-120231, the operating oil flowing out of a discharge port of the direction switching valve is supplied into the oil pressure chamber through the oil passage of the cylinder head and the oil passage of the cam shaft. Thus, the foreign substances contained in the above oil passages may enter into the oil pressure chamber. Particularly, at a connection part between the oil passage of the cylinder head and the oil passage of the cam shaft, there is a bearing part of the cylinder head for rotatably supporting the cam shaft. Accordingly, worn powder produced at this bearing part may enter into the oil pressure chamber.

Against this, there may be taken a measure to provide the direction switching valve at an oil passage of the vane rotor and to provide the filter at a supply port of the direction switching valve. Therefore, the direction switching valve and the filter are provided inside the valve timing adjusting device. As a result, the foreign substances in the oil passage of the cylinder head and the oil passage of the cam shaft can be captured by the filter.

However, in a mode where a check valve is provided on an upstream side of the direction switching valve to prevent a backflow of the oil supplied to the oil pressure chamber, if the filter is provided at the supply port of the direction switching valve as described above, the foreign substances pass through the check valve. Consequently, the check valve may not be closed because of the foreign substance lodging between a valving element and a valve seat of the check valve.

SUMMARY

The present disclosure addresses at least one of the above issues.

According to the present disclosure, there is provided a valve timing adjusting device adapted to be provided on a drive force transmission route from a driving shaft to a driven shaft of an engine. The valve timing adjusting device adjusts valve timing of a valve which is opened or closed by the driven shaft, and includes a housing, a vane rotor, a direction switching valve, a check valve, a fixing unit, and a filter. The housing is rotatable integrally with a first shaft which is one of the driving shaft and the driven shaft. The vane rotor is rotatable integrally with a second shaft which is the other one of the driving shaft and the driven shaft, and defines an advance chamber and a retard chamber between the vane rotor and the housing. The vane rotor includes a second supply oil passage connectable to a first supply oil passage of the second shaft. The direction switching valve is provided at a central part of the vane rotor. The direction switching valve connects together the second supply oil passage and the advance chamber at time of rotation of the vane rotor toward an advance side relative to the housing, and connects together the second supply oil passage and the retard chamber at time of rotation of the vane rotor toward a retard side relative to the housing. The check valve is provided between the vane rotor and the second shaft, and permits a flow in a direction from the first supply oil passage toward the second supply oil passage and prevents a flow in a direction from the second supply oil passage toward the first supply oil passage. The fixing unit is provided between the check valve and the second shaft, and fixes the check valve between the fixing unit and the vane rotor. The fixing unit includes a third supply oil passage which connects together the first supply oil passage and the second supply oil passage. The filter is provided for the fixing unit and is capable of capturing foreign substances flowing through the third supply oil passage.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
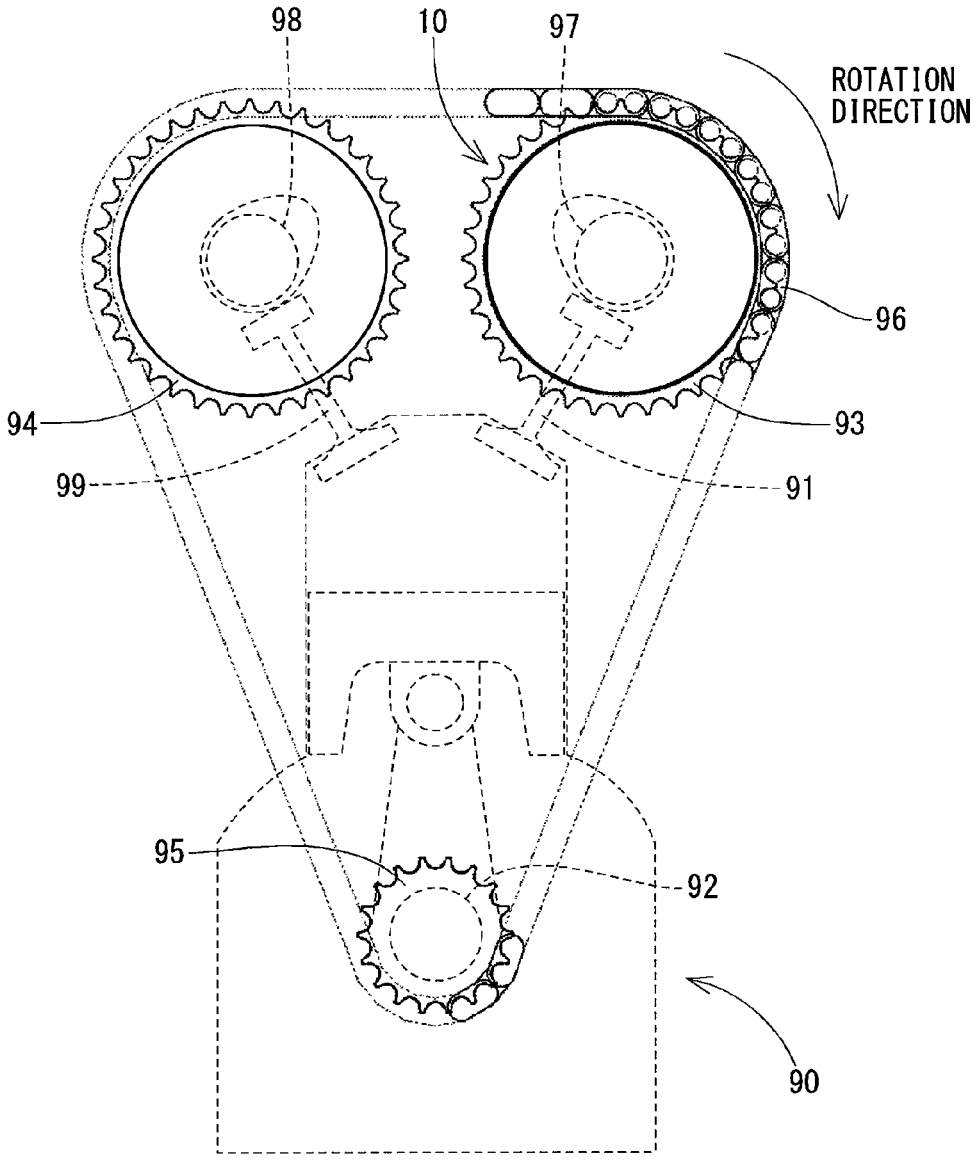
FIG. 1 is a diagram illustrating a general configuration of an engine to which a valve timing adjusting device in accordance with a first embodiment is applied.

Embodiments will be described below in reference to the drawings. To indicate substantially the same configurations between the embodiments, the same reference numerals are used to omit their descriptions.

(First Embodiment)

A valve timing adjusting device in a first embodiment is for adjusting valve timing of an intake valve 91 of an engine 90 in FIG. 1. As illustrated in FIG. 1, rotation of a crankshaft (driving shaft) 92 which is a drive shaft of the engine 90 is transmitted to cam shafts 97, 98 via a chain 96 wound around sprockets 93, 94, 95. The cam shaft (driven shaft) 97 is a driven shaft for opening or closing the intake valve 91, and the cam shaft 98 is a driven shaft for opening or closing an exhaust valve 99.

A valve timing adjusting device 10 rotates the cam shaft 97 in a rotation direction relative to the sprocket 93, which rotates integrally with the crankshaft 92, so as to make early the valve timing of the intake valve 91. To relatively rotate the cam shaft 97, thereby making early the valve timing of the intake valve 91 in this manner is referred to as "to advance". In addition, the valve timing adjusting device 10 rotates the cam shaft 97 in an opposite direction from the rotation direction relative to the sprocket 93 so as to delay the valve timing of the intake valve 91. To relatively rotate the cam shaft 97, thereby delaying the valve timing of the intake valve 91 in this manner is referred to as "to retard".

Figure 2:
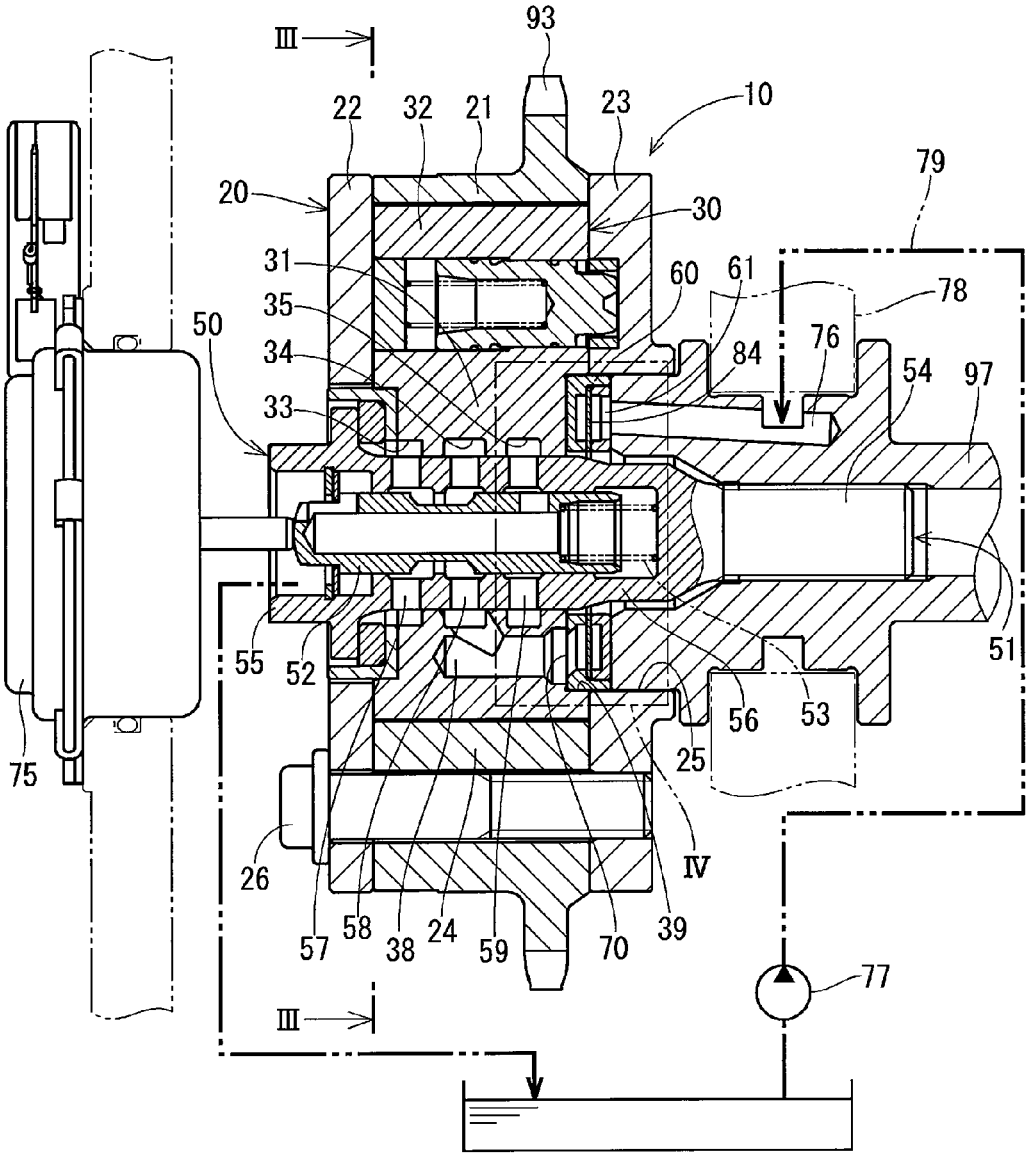
FIG. 2 is a longitudinal sectional view illustrating the valve timing adjusting device in FIG. 1.
Figure 3:
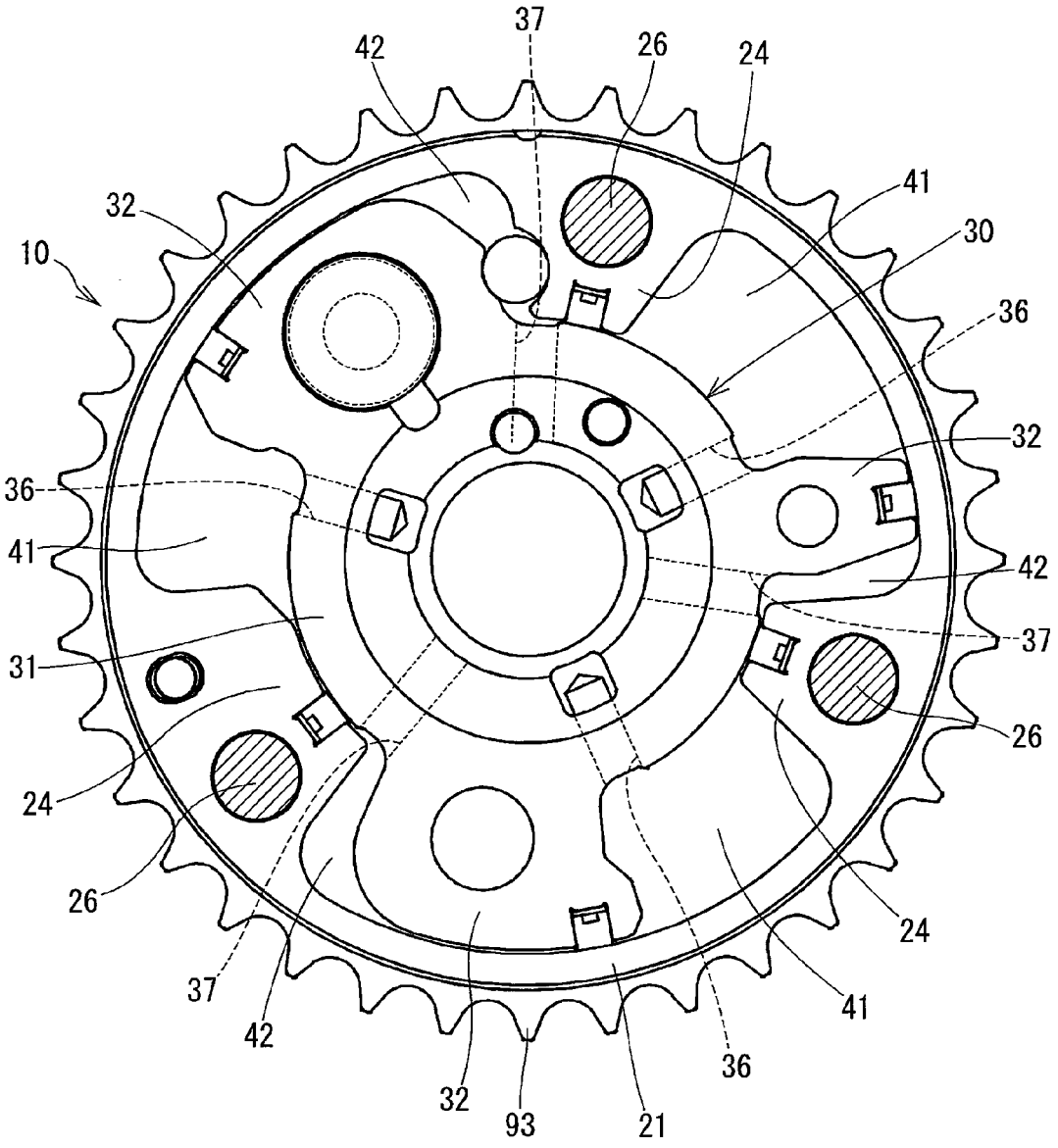
FIG. 3 is a cross-sectional view illustrating the valve timing adjusting device taken along a line in FIG. 2.

A general configuration of the valve timing adjusting device 10 will be described in reference to FIGS. 2 and 3. As illustrated in FIGS. 2 and 3, the valve timing adjusting device 10 includes a housing 20, a vane rotor 30, a direction switching valve 50, a bushing 60, and a check valve 70.

The housing 20 includes a cylindrical member 21, a front plate 22, and a rear plate 23. The cylindrical member 21 is provided coaxially with the cam shaft 97, and includes projecting parts 24 which project radially inwardly. The sprocket 93 is provided integrally with an outer wall of the cylindrical member 21. The front plate 22 is provided on one side of the cylindrical member 21 in the axial direction. The rear plate 23 is provided on the other side of the cylindrical member 21, in the axial direction and includes a fitting hole 25 at its central part. The cam shaft 97 is fitted into the fitting hole 25 of the rear plate 23. The cylindrical member 21, the front plate 22, and the rear plate 23 are fixed together by a bolt 26. The housing 20 is rotatable integrally with the crankshaft 92.

The vane rotor 30 is provided to be rotatable relative to the housing 20 in the housing 20, and includes a boss part 31 and vane parts 32. The boss part 31 is cylindrically formed and is provided coaxially with the cam shaft 97. Each vane part 32 projects radially to divide a space defined between the two projecting parts 24 of the cylindrical member 21 into an advance chamber 41 and a retard chamber 42. The boss part 31 includes three annular grooves 33, 34, 35 on its inner wall. The annular groove 33 is connected to the advance chamber 41 through an advance oil passage 36. The annular groove 35 is connected to the retard chamber 42 through a retard oil passage 37. The annular groove 34 is connected to a supply oil passage 38 which extends toward the cam shaft 97 in the axial direction. The vane rotor 30 is fixed to the cam shaft 97 by a sleeve bolt 51 to be rotatable integrally with the cam shaft 97. The supply oil passage 38 is connectable to a supply oil passage 76 of the cam shaft 97. The supply oil passage 76 may correspond to a "first supply oil passage". The supply oil passage 38 may correspond to a "second supply oil passage".

The direction switching valve 50 includes the sleeve bolt 51, a spool 52, and a spring 53. The sleeve bolt 51 includes a cylindrical sleeve part 56 between a thread part 54 and a head part 55. The sleeve part 56 includes an advance port 57, a supply port 58, and a retard port 59, which are holes passing through the sleeve part 56 in the radial direction. The advance port 57 communicates with the annular groove 33, the supply port 58 communicates with the annular groove 34, and the retard port 59 communicates with the annular groove 35. The spool 52 can reciprocate in the axial direction in the sleeve part 56 of the sleeve bolt 51, and can make a selective connection between the ports of the sleeve part 56 according to its axial position. The axial position of the spool 52 is determined by a balance between urging force by the spring 53 and pressing force by a solenoid 75.

The bushing 60 is provided between the cam shaft 97 and the vane rotor 30, and is press-fitted into a press-fit hole 39 of the vane rotor 30. The bushing 60 includes a supply oil passage 61 that connects together the supply oil passage 38 of the vane rotor 30 and the supply oil passage 76 of the cam shaft 97. Operating oil discharged by an oil pump 77 is supplied to the supply oil passage 61 through a supply oil passage 79 of a cylinder head 78 and the supply oil passage 76 of the cam shaft 97. The bushing 60 clamps the check valve 70 between the vane rotor 30 and the bushing 60, and may correspond to a "fixing unit". The supply oil passage 61 may correspond to a "third supply oil passage".

The check valve 70 is a reed valve including a plate-shaped valving element with resilience, and can open or close the supply oil passage 61 of the bushing 60. This valving element is opened when the operating oil flows from the supply oil passage 61 of the bushing 60 toward the supply oil passage 38 of the vane rotor 30, and is closed when the operating oil flows from the supply oil passage 38 toward the supply oil passage 61. In other words, the check valve 70 permits a flow in a direction from the supply oil passage 61 of the bushing 60 toward the supply oil passage 38 of the vane rotor 30, and prevents a flow in the opposite direction of this. Accordingly, the operating oil in the supply oil passage 38 is prevented from flowing back toward the supply oil passage 76.

In the valve timing adjusting device 10 having the above-described configuration, when a rotation phase is on a retard side of a target value, the advance chamber 41 is connected to the supply oil passage 38, and the retard chamber 42 is connected to an external drain space by the direction switching valve 50. Accordingly, operating oil is supplied into the advance chamber 41, and the operating oil in the retard chamber 42 is discharged into the outside, thereby the vane rotor 30 rotating toward an advance side relative to the housing 20.

When the rotation phase is on an advance side of the target value, the retard chamber 42 is connected to the supply oil passage 38, and the advance chamber 41 is connected to the external drain space by the direction switching valve 50. Accordingly, operating oil is supplied into the retard chamber 42, and the operating oil in the advance chamber 41 is discharged into the outside, thereby the vane rotor 30 rotating toward a retard side relative to the housing 20. In addition, when the rotation phase coincides with the target value, the advance chamber 41 and the retard chamber 42 are closed by the direction switching valve 50. As a result, the vane rotor 30 rotates in the same phase as the housing 20.

Figure 4:
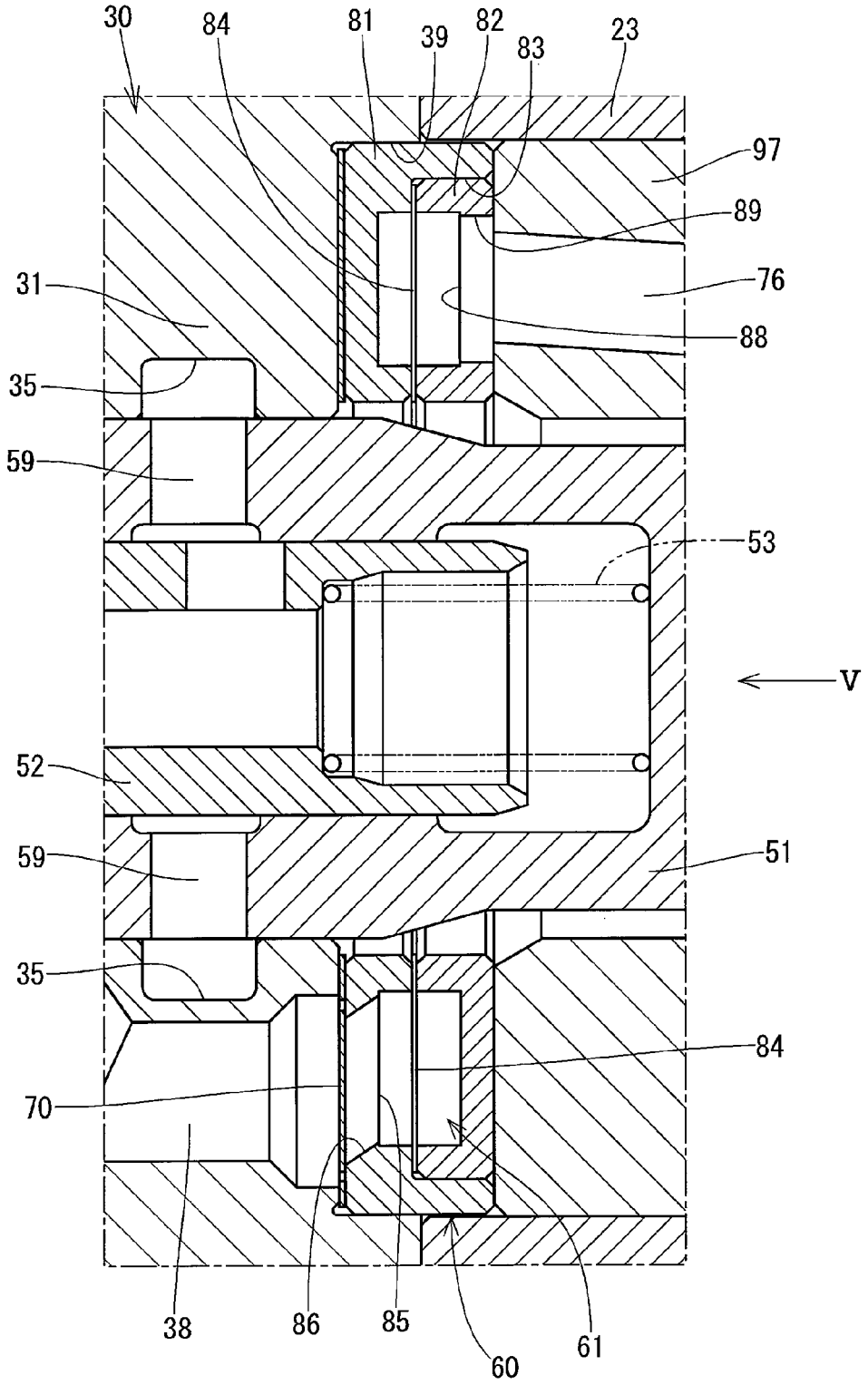
FIG. 4 is an enlarged view illustrating a part IV in FIG. 2.
Figure 5:
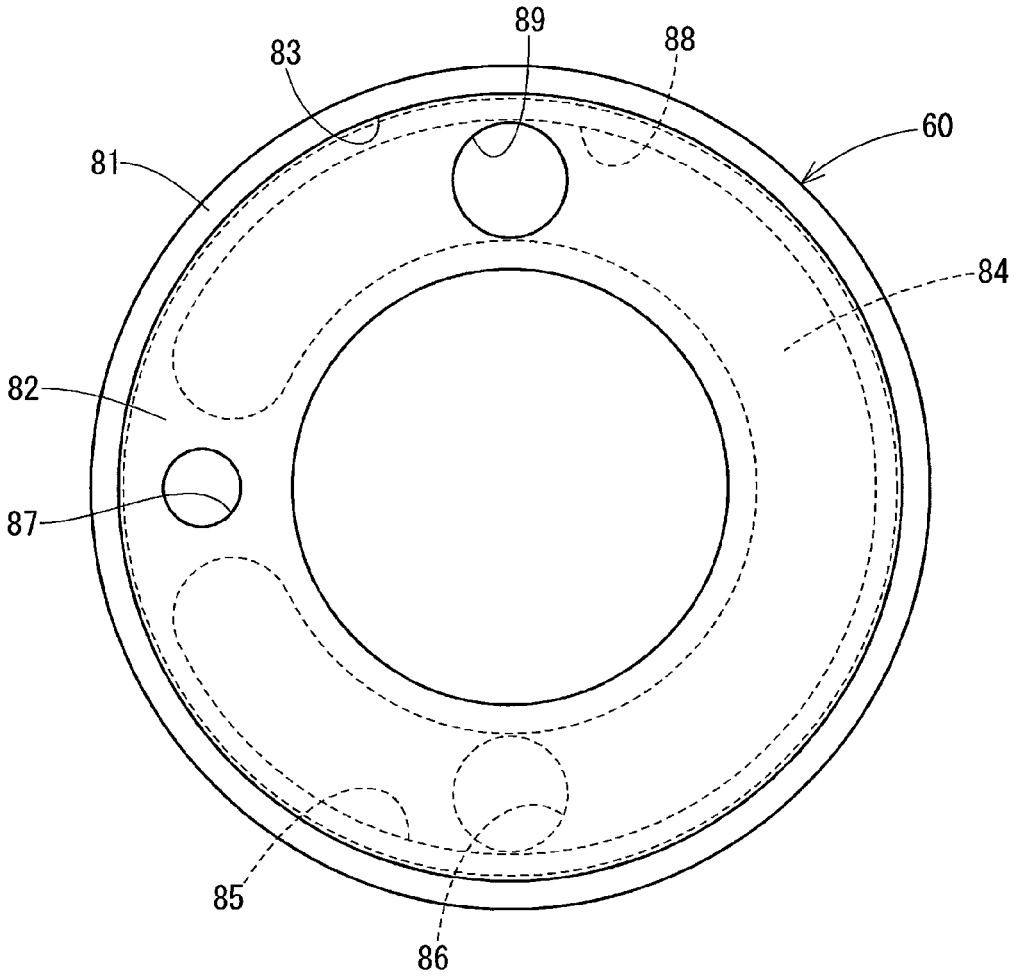
FIG. 5 is a diagram illustrating a bushing and a filter in FIG. 4 viewed from a direction of an arrow V.

A characteristic configuration of the valve timing adjusting device 10 will be described with reference to FIGS. 2, 4, and 5. As illustrated in FIGS. 2, 4, and 5, the bushing 60 includes two annular plates 81, 82. The annular plate (first plate) 81 is a plate having a shape of a circular disk, and is press-fitted in the press-fit hole 39 of the vane rotor 30. The check valve 70 is clamped between the annular plate 81 and a bottom wall of the press-fit hole 39. The annular plate 81 includes a fitting hole 83 at its wall part on the opposite side from the check valve 70.

The annular plate (second plate) 82 is a plate having a shape of a circular disk, and is press-fitted into the fitting hole 83 of the annular plate 81. A filter 84 is provided between a bottom wall of the fitting hole 83 of the annular plate 81 and the annular plate 82. The filter 84 is configured by a metal mesh. The annular plate 82 clamps the filter 84 between the annular plate 82 and the bottom wall of the fitting hole 83.

The annular plate 81 includes a circumferential groove 85, a through hole 86, and a first positioning hole 87 on a bottom wall of the fitting hole 83. The circumferential groove 85 is a groove extending in the circumferential direction to avoid a positioning pin (not shown) for determining the positions of the cam shaft 97 and the vane rotor 30 in the rotation direction. The through hole 86 is a hole passing axially through a part of a bottom part of the circumferential groove 85 at a circumferential position corresponding to the supply oil passage 38 of the vane rotor 30. The first positioning hole 87 is a hole into which the above positioning pin is inserted.

The annular plate 82 includes a circumferential groove 88, a through hole 89, and a second positioning hole (not shown). The circumferential groove 88 is a groove extending in the circumferential direction to avoid the positioning pin, and is opposed to the circumferential groove 85 with the filter 84 therebetween. The through hole 89 is a hole passing axially through a part of a bottom part of the circumferential groove 88 at a circumferential position corresponding to the supply oil passage 76 of the cam shaft 97. The second positioning hole is a hole which is formed at a circumferential position corresponding to the first positioning hole 87, and into which the positioning pin is inserted.

The supply oil passage 61 of the bushing 60 includes the through hole 89, the circumferential groove 88, the circumferential groove 85, and the through hole 86. A passage sectional area of the supply oil passage 61 is increased by the circumferential grooves 85, 88 between the through hole 89 and the through hole 86. Thus, the circumferential grooves 85, 88 define an enlarged oil passage. The filter 84 is provided at this enlarged oil passage of the supply oil passage 61.

The operating oil supplied from the supply oil passage 76 of the cam shaft 97 to the valve timing adjusting device 10 first flows into the circumferential groove 88 through the through hole 89 of the annular plate 82. Then, the operating oil flows from the circumferential groove 88 through the filter 84 into the circumferential groove 85, and is supplied to the supply oil passage 38 of the vane rotor 30 through the through hole 86. A total opening area of the filter 84 in the supply oil passage 61 is larger than a passage sectional area of the narrowest part of the supply oil passage 76, the supply oil passage 61, and the supply oil passage 38.

In the above description, the annular plate 81 may correspond to a "first plate", and the annular plate 82 may correspond to a "second plate." The through holes 86 may correspond to a "first through hole", and the through holes 89 may correspond to a "second through hole." The circumferential groove 85 may correspond to a "first circumferential groove", and the circumferential groove 88 may correspond to a "second circumferential groove".

Effects of the first embodiment will be described below. As described above, in the valve timing adjusting device 10 of the first embodiment, the bushing 60 is provided between the vane rotor 30 and the cam shaft 97. The supply oil passage 61 of the bushing 60 connects the supply oil passage 38 of the vane rotor 30 and the supply oil passage 76 of the cam shaft 97, and is located on an upstream side of the advance chamber 41, the retard chamber 42, the direction switching valve 50, and the check valve 70. The filter 84 is provided in the supply oil passage 61 of the bushing 60, and can capture the foreign substances contained in the operating oil flowing from the supply oil passage 76 of the cam shaft 97 into the supply oil passage 61. Accordingly, in the present embodiment, there can be limited the entry of external foreign substances into the advance chamber 41, the retard chamber 42, the direction switching valve 50, and the check valve 70.

In the first embodiment, the bushing 60 includes the two annular plates 81, 82. The annular plate 81 can clamp the check valve 70 between the annular plate 81 and the vane rotor 30. The annular plate 82 can clamp the filter 84 between the annular plate 82 and the annular plate 81.

In the first embodiment, the annular plate 81 includes the circumferential groove 85 and the through hole 86, and the annular plate 82 includes the circumferential groove 88 and the through hole 89. The supply oil passage 61 of the bushing 60 includes the through hole 89, the circumferential groove 88, the circumferential groove 85, and the through hole 86. The circumferential grooves 85, 88 are configured as the enlarged oil passage that increases the passage sectional area of the supply oil passage 61, and the filter 84 is provided at this enlarged oil passage of the supply oil passage 61. Accordingly, a pressure loss due to the filter 84 can be made relatively small.

In the first embodiment, the through hole 86 is located at a different circumferential position from the through hole 89. Thus, the circumferential position of the through hole 86 relative to the through hole 89 can be appropriately changed according to a relative positional relationship between the supply oil passage 76 of the cam shaft 97 and the supply oil passage 38 of the vane rotor 30. Accordingly, a common vane rotor 30 can be used for the models with the different relative positional relationships between the supply oil passage 76 and the supply oil passage 38.

In the first embodiment, the annular plate 82 is fixed by being press-fitted into the fitting hole 83 of the annular plate 81. Therefore, a fixing member for fixing the annular plate 82 does not need to be separately provided.

In the first embodiment, the total opening area of the filter 84 in the supply oil passage 61 is larger than the passage sectional area of the narrowest part of the supply oil passage 76, the supply oil passage 61, and the supply oil passage 38. Accordingly, a pressure loss due to the filter 84 can be made relatively small.

In the first embodiment, a filter is unnecessary at an inlet of the supply port 58 of the sleeve bolt 51 of the direction switching valve 50. Accordingly, an annular installation groove which is conventionally formed at the inlet of the supply port 58 of the sleeve bolt 51 for arranging a filter is made unnecessary. As a result, there is eliminated a need for designing the large outer diameter of the sleeve bolt 51 in view of stress concentration on the position of the above installation groove. Thus, in the present embodiment, the outer diameter of the sleeve bolt 51 can be made smaller than the conventional art. Consequently, the outer diameters of the vane rotor 30 and the housing 20 can be made smaller than the conventional art, thereby downsizing the valve timing adjusting device 10.

(Second Embodiment)

Figure 6:
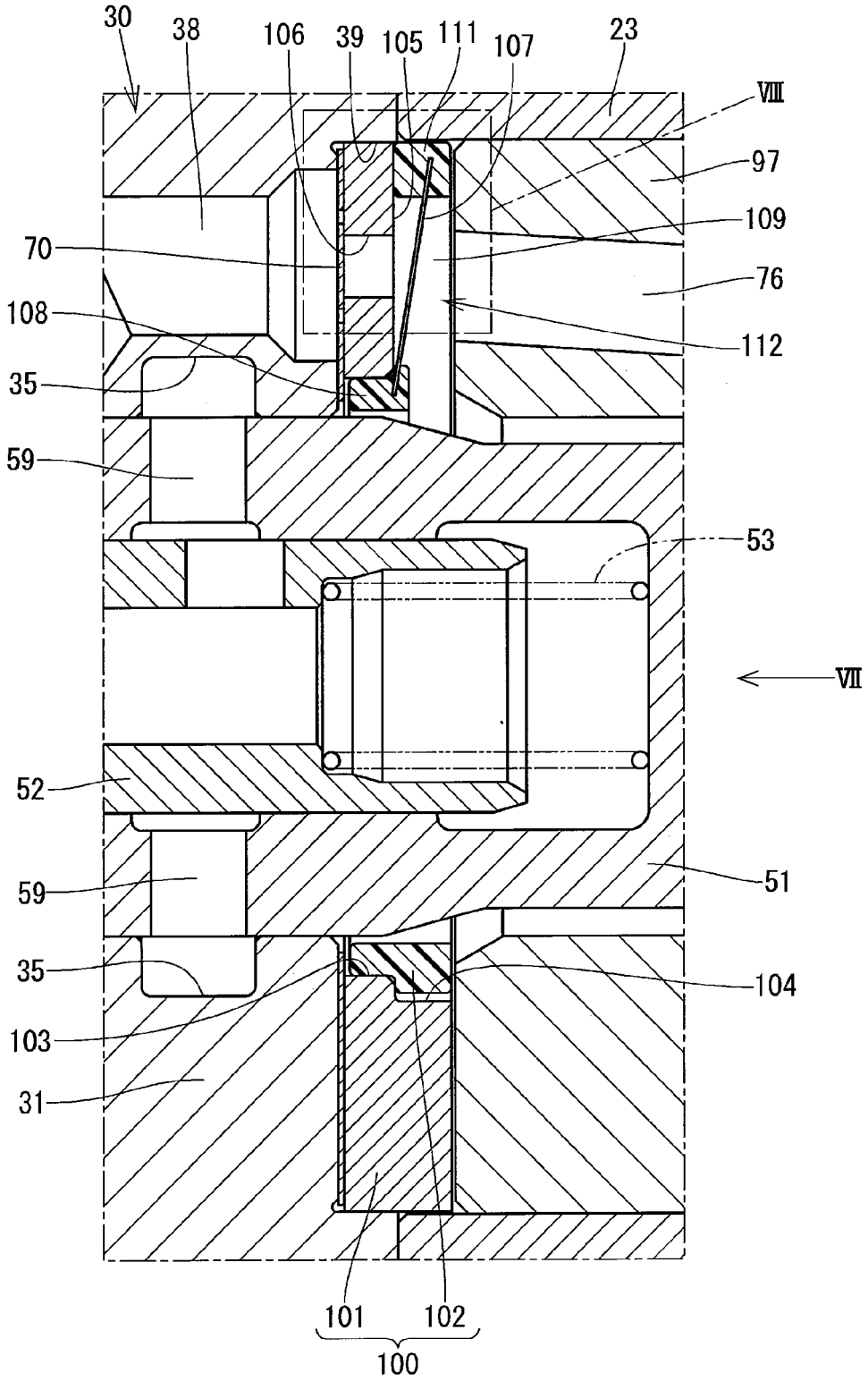
FIG. 6 is a sectional view illustrating a bushing and a filter of a valve timing adjusting device in accordance with a second embodiment and corresponding to FIG. 4 in the first embodiment.
Figure 7:
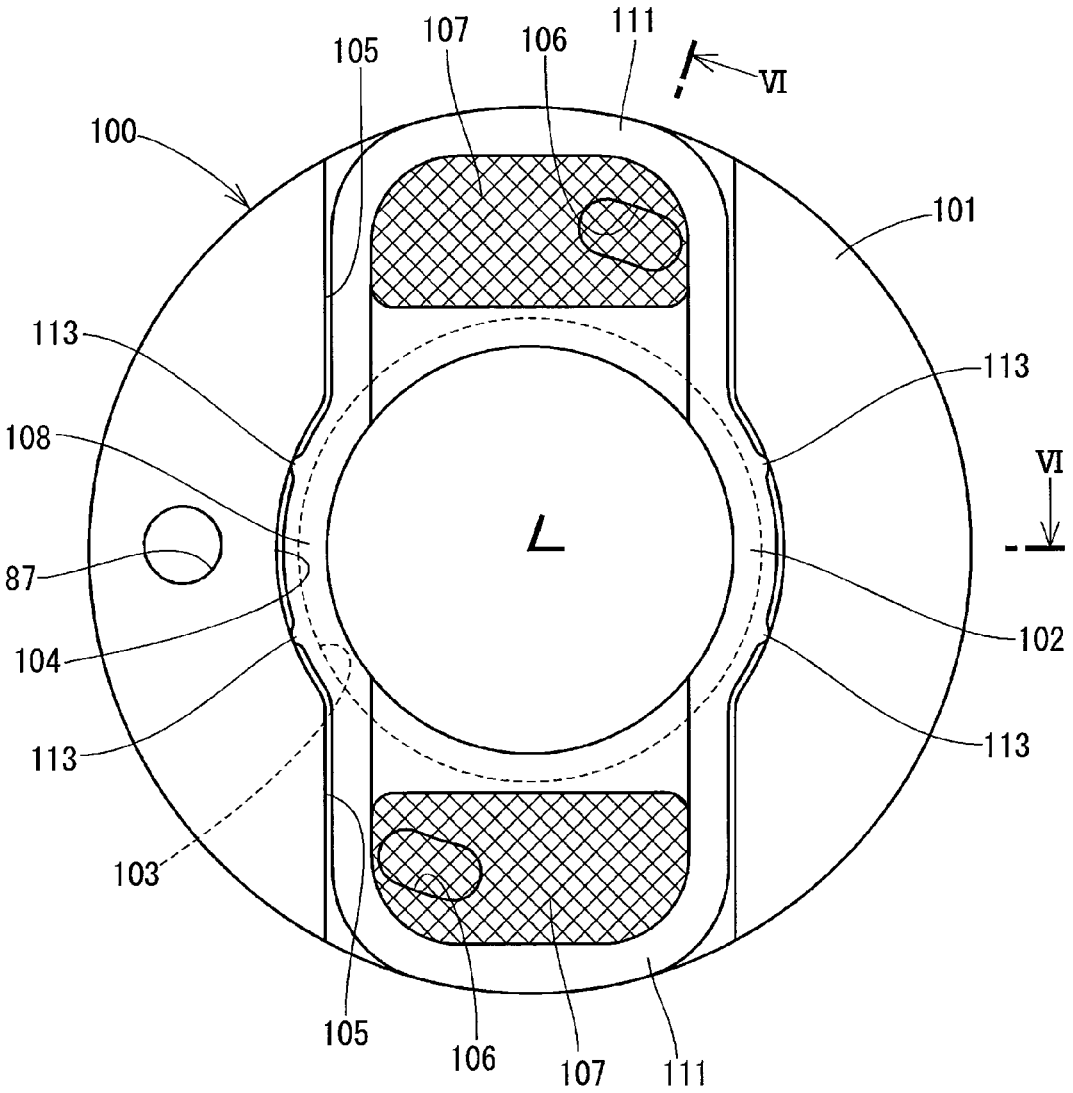
FIG. 7 is a diagram illustrating the bushing and the filter in FIG. 6 viewed from a direction of an arrow VII.
Figure 8:
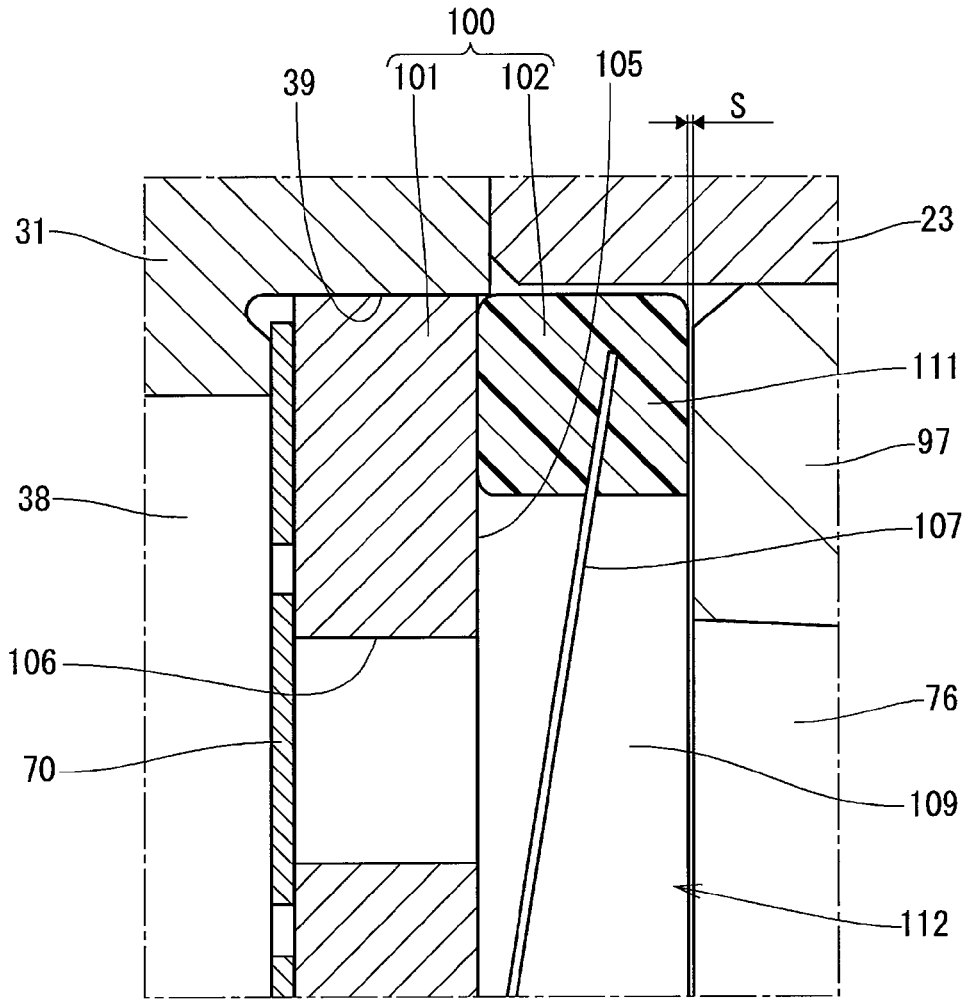
FIG. 8 is an enlarged view illustrating a part VIII in FIG. 6.

A valve timing adjusting device in a second embodiment will be described in reference to FIGS. 6 to 8. A characteristic configuration of the device of the second embodiment will be described below. In the second embodiment, as illustrated in FIGS. 6 to 8, a bushing 100 includes a base member 101 and a resin formation member 102.

The base member 101 is a metal plate having a shape of a circular disk, and is press-fitted into a press-fit hole 39 of a vane rotor 30. The base member 101 includes an insertion hole 103 in which a sleeve bolt 51 is inserted, a fitting recessed part 104 formed at a wall part on the opposite side from a check valve 70, a radial groove 105 extending radially outward of the fitting recessed part 104, and a through hole 106 passing axially through a bottom part of the radial groove 105 at a circumferential position substantially corresponding to a supply oil passage 38 of the rotor 30. In the present embodiment, the two radial grooves 105 and the two through holes 106 are formed.

The check valve 70 is clamped between the base member 101 and a bottom wall of the press-fit hole 39, and includes a valving element that can open or close the through hole 106 of the base member 101. The resin formation member 102 is provided between the base member 101 and a cam shaft 97, and a filter 107 is inserted in the member 102. Specifically, the resin formation member 102 includes an annular fitting part 108 which is fitted into the fitting recessed part 104 of the base member 101 in which the sleeve bolt 51 is inserted; and a filter part 111, which projects radially outward from a circumferential position of the fitting part 108 corresponding to the radial groove 105 and is formed in a shape of a frame to define a space 109 therein, and in which the filter 107 is inserted to cover the space 109. The space 109 communicates with a supply oil passage 76 of the cam shaft 97 and constitutes a supply oil passage 112.

The resin formation member 102 is made by insert molding. Specifically, the resin formation member 102 is made by setting the filter 107 in a die beforehand, pouring molten resin into this die, and integrating the resin cooled and solidified in the die, and the filter 107. The resin formation member 102 may correspond to a "formation member".

The fitting part 108 of the resin formation member 102 includes press-fit protrusions 113 which project radially outward and are press-fitted in the fitting recessed part 104 of the base member 101. In the present embodiment, when the resin formation member 102 is viewed in the axial direction, the two press-fit protrusions 113 are formed respectively on both sides with the filter part 111 therebetween. The resin formation member 102 is fixed by press-fitting each press-fit protrusion 113 into the fitting recessed part 104 of the base member 101. In the present embodiment, the fitting part 108 is formed into a stepped shape, and is press-fitted in the fitting recessed part 104 until the stepped part is brought into contact with a bottom surface of the fitting recessed part 104 of the base member 101. An axial distance S of an axial clearance defined by the resin formation member 102 with respect to the base member 101 or the cam shaft 97 is set to be equal to or smaller than a mesh size of the filter 107.

The bushing 100 includes a supply oil passage 112 connecting the supply oil passage 38 of the vane rotor 30 and the supply oil passage 76 of the cam shaft 97. This supply oil passage 112 may correspond to the "third supply oil passage", and includes the through hole 106 of the base member 101 and the space 109 of the resin formation member 102. The space 109 has a larger radial size and larger circumferential size than the through hole 106 and the supply oil passage 76. A passage sectional area of the supply oil passage 112 is increased by the space 109 between the through hole 106 and the supply oil passage 76. Thus, the space 109 is configured as an enlarged oil passage. The filter 107 is provided in this enlarged oil passage of the supply oil passage 112. A total opening area of the filter 107 in the supply oil passage 112 is larger than a passage sectional area of the narrowest part of the supply oil passage 76, the supply oil passage 38, and the supply oil passage 112.

Effects of the second embodiment will be described below. As described above, in the second embodiment, the bushing 100 is provided between the vane rotor 30 and the cam shaft 97. The filter 107 is located on an upstream side of the advance chamber 41, a retard chamber 42, a direction switching valve 50, and the check valve 70, and can capture the foreign substances contained in the operating oil flowing from the supply oil passage 76 of the cam shaft 97 into the supply oil passage 112 of the bushing 100. Accordingly, in the second embodiment, similar to the first embodiment, there can be limited the entry of external foreign substances into the advance chamber 41, the retard chamber 42, the direction switching valve 50, and the check valve 70.

In the second embodiment, the bushing 100 includes the base member 101 and the resin formation member 102. The base member 101 fixes the check valve 70 between the base member 101 and the vane rotor 30. The resin formation member 102 is provided between the base member 101 and the cam shaft 97, and the filter 107 is inserted in the resin formation member 102. Accordingly, the check valve 70 is fixable by the base member 101, and furthermore, the filter 107 can be fixed on an upstream side of this check valve 70 and on a downstream side of the supply oil passage 76 of the cam shaft 97.

In the second embodiment, the axial distance S of the axial clearance defined by the resin formation member 102 with respect to the base member 101 or the cam shaft 97 is set to be equal to or smaller than a mesh size of the filter 107. Accordingly, there can be prevented a flow of the operating oil of the supply oil passage 76 of the cam shaft 97 into the check valve 70 without the operating oil flowing through the filter 107. Thus, there can be prevented the entry of external foreign substances into the check valve 70 without the substances passing through the filter 107.

In the second embodiment, the resin formation member 102 includes the annular fitting part 108 which is fitted in the fitting recessed part 104 of the base member 101; and the filter part 111, which projects radially outward from a circumferential position of the fitting part 108 corresponding to the radial groove 105 and is formed in a shape of a frame to define therein the space 109 that constitutes the supply oil passage 112, and in which the filter 107 is inserted to cover the space 109. Accordingly, the fitting part 108 as a means for fixing the resin formation member 102 to the base member 101, and the filter part 111 as a means for holding the filter 107 are separated. As a result, the force, which is applied to the fitting part 108 when the fitting part 108 is fixed to the base member 101, is not easily transmitted to the filter part 111. Thus, reduction of holding force of the filter 107 due to the application of this force to an interface between the filter part 111 and the filter 107 can be limited.

In the second embodiment, the fitting part 108 of the resin formation member 102 includes the press-fit protrusions 113 which project radially outward and are press-fitted in the fitting recessed part 104 of the base member 101. Accordingly, the resin formation member 102 is fixable to the base member 101. Moreover, a fixing member for fixing the resin formation member 102 to the base member 101 does not need to be separately provided.

In the second embodiment, the total opening area of the filter 107 in the supply oil passage 112 is larger than the passage sectional area of the narrowest part of the supply oil passage 76, the supply oil passage 38, and the supply oil passage 112. Accordingly, the pressure loss due to the filter 107 can be made relatively small.

In the second embodiment, the passage sectional area of the supply oil passage 112 is increased by the space 109 between the through hole 106 and the supply oil passage 76. The filter 107 is provided in the space 109. Accordingly, the total opening area of the filter 107 in the supply oil passage 112 can be made larger than the passage sectional area of the narrowest part of the supply oil passage 76, the supply oil passage 38, and the supply oil passage 112.

In the second embodiment, the space 109 has a larger radial size and larger circumferential size than the through hole 106 and the supply oil passage 76. Accordingly, the circumferential position of the through hole 106 relative to the space 109 can be appropriately changed according to a relative positional relationship between the supply oil passage 76 of the cam shaft 97 and the supply oil passage 38 of the vane rotor 30. Accordingly, a common vane rotor 30 can be used for the models with the different relative positional relationships between the supply oil passage 76 and the supply oil passage 38.

(Third Embodiment)

Figure 9:
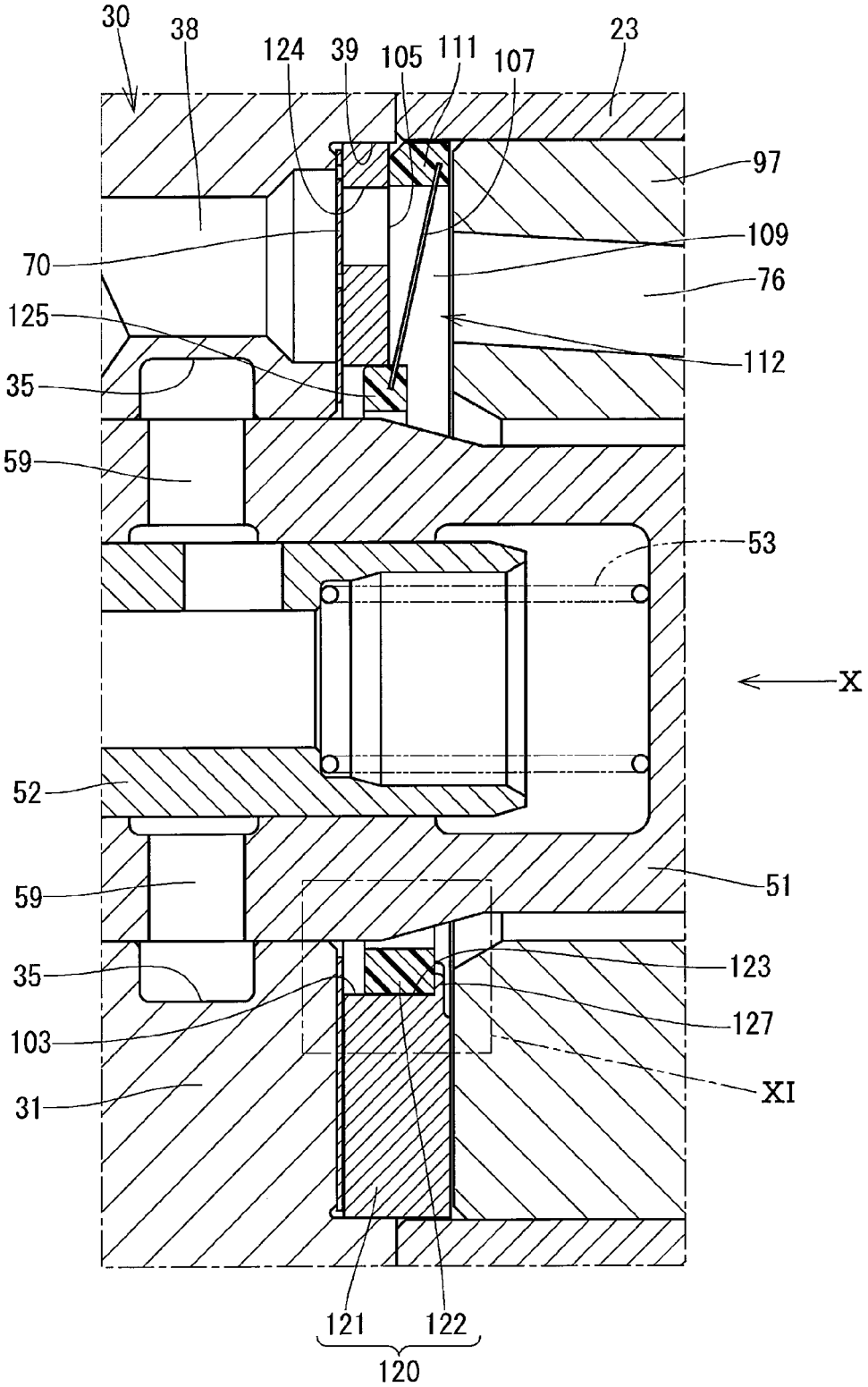
FIG. 9 is a sectional view illustrating a bushing and a filter of a valve timing adjusting device in accordance with a third embodiment and corresponding to FIG. 4 in the first embodiment.
Figure 10:
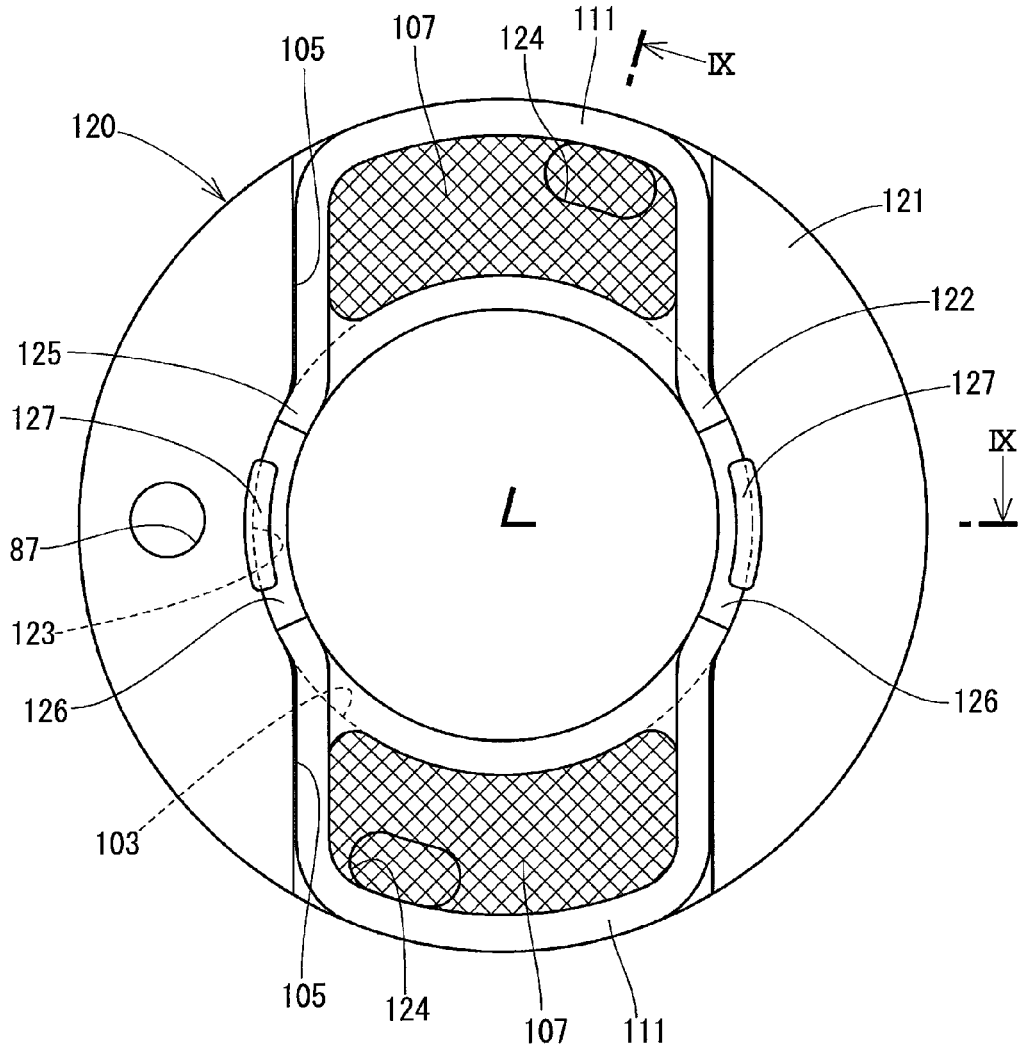
FIG. 10 is a diagram illustrating the bushing and the filter in FIG. 9 viewed from a direction of an arrow X.
Figure 11:
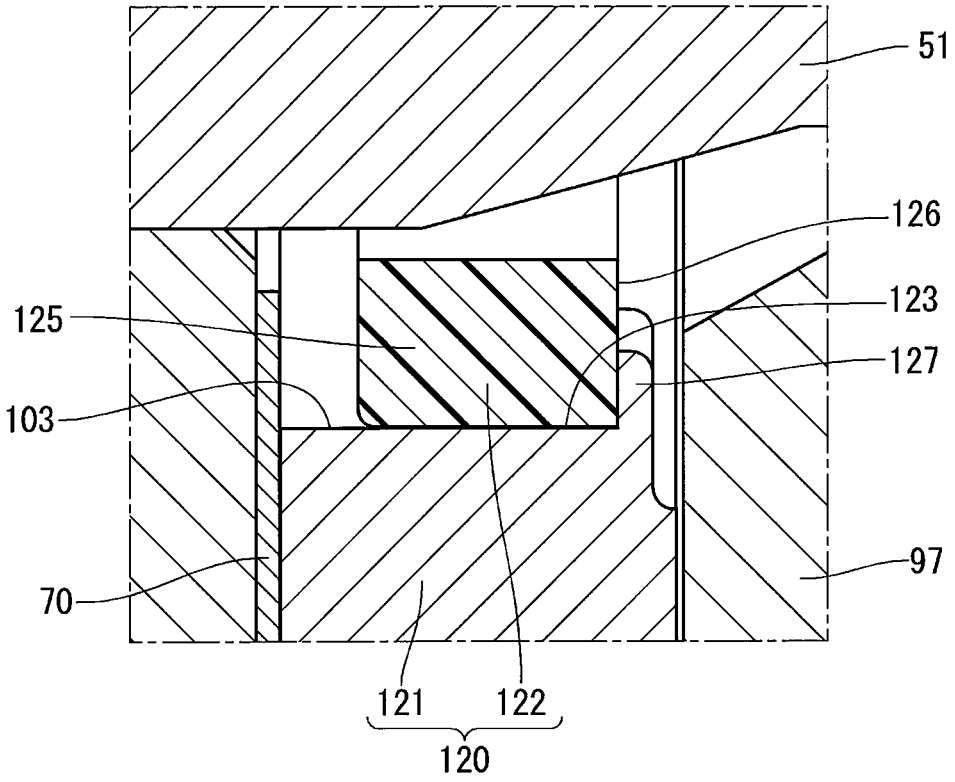
FIG. 11 is an enlarged view illustrating a part XI in FIG. 9.

A valve timing adjusting device in a third embodiment will be described in reference to FIGS. 9 to 11. A characteristic configuration of the device of the third embodiment will be described below. In the third embodiment, as illustrated in FIGS. 9 and 10, a bushing 120 includes a base member 121 and a resin formation member 122. An inner diameter of a fitting recessed part 123 of the base member 121 is the same as an inner diameter of an insertion hole 103. A position of a through hole 124 passing through a bottom part of the radial groove 105 of the base member 121 in the axial direction is different from the through hole 106 of the base member 101 of the second embodiment.

As illustrated in FIG. 10, recessed parts 126 are formed between two filter parts 111 on a cam shaft 97-side wall portion of a fitting part 125 of the resin formation member 122. As illustrated in FIGS. 9 to 11, the fitting recessed part 123 of the base member 121 includes a crimped projection 127 whose circumferential position corresponds to the recessed part 126 and which is formed by crimping a rim of the recessed part 123 radially inwardly. The crimped projection 127 is engaged with the fitting part 125 to prevent the displacement of the resin formation member 122 in a direction in which the member 122 is separated. Thus, the crimped projection 127 is a restricting means for restricting the separation of the resin formation member 122.

Effects of the third embodiment will be described below. As described above, in the third embodiment, the base member 121 includes the crimped projection 127 which is formed by crimping the rim of the fitting recessed part 123 and is engaged with the fitting part 125 to prevent the displacement of the resin formation member 122 in a direction in which the member 122 is separated. Accordingly, the resin formation member 122 is fixable to the base member 121. Moreover, a fixing member for fixing the resin formation member 122 to the base member 121 does not need to be separately provided.

(Fourth Embodiment)

Figure 12:
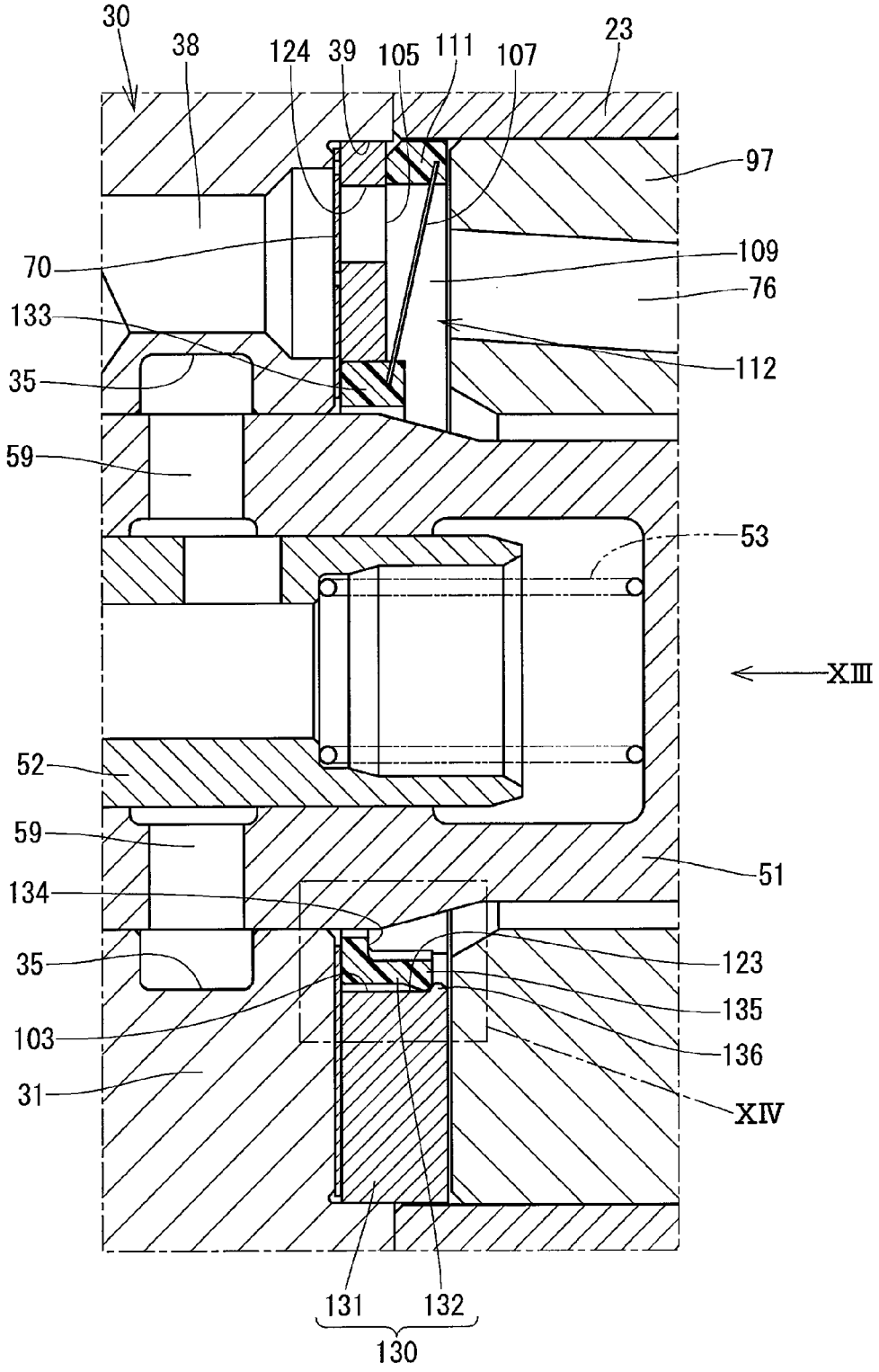
FIG. 12 is a sectional view illustrating a bushing and a filter of a valve timing adjusting device in accordance with a fourth embodiment and corresponding to FIG. 4 in the first embodiment.
Figure 13:
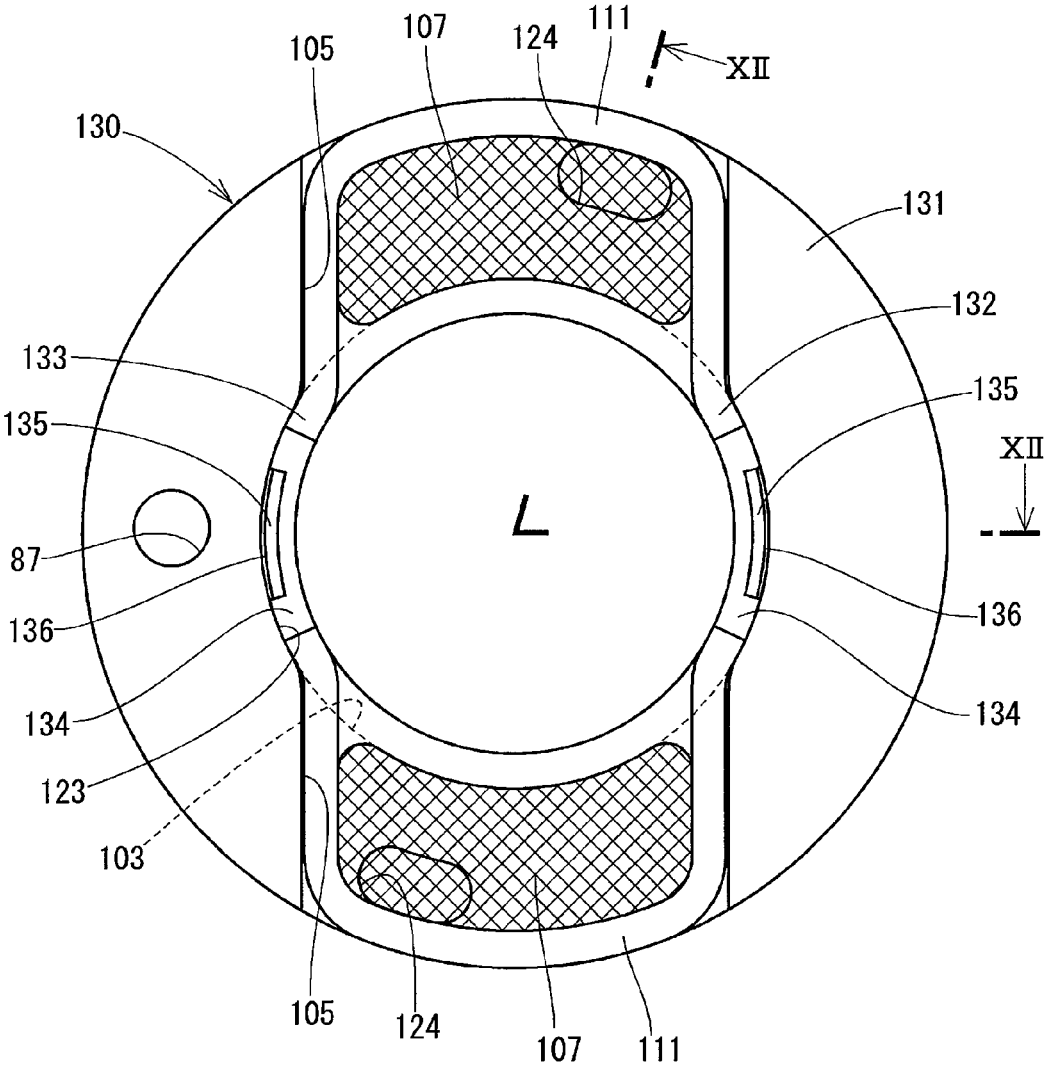
FIG. 13 is a diagram illustrating the bushing and the filter in FIG. 12 viewed from a direction of an arrow XIII.
Figure 14:
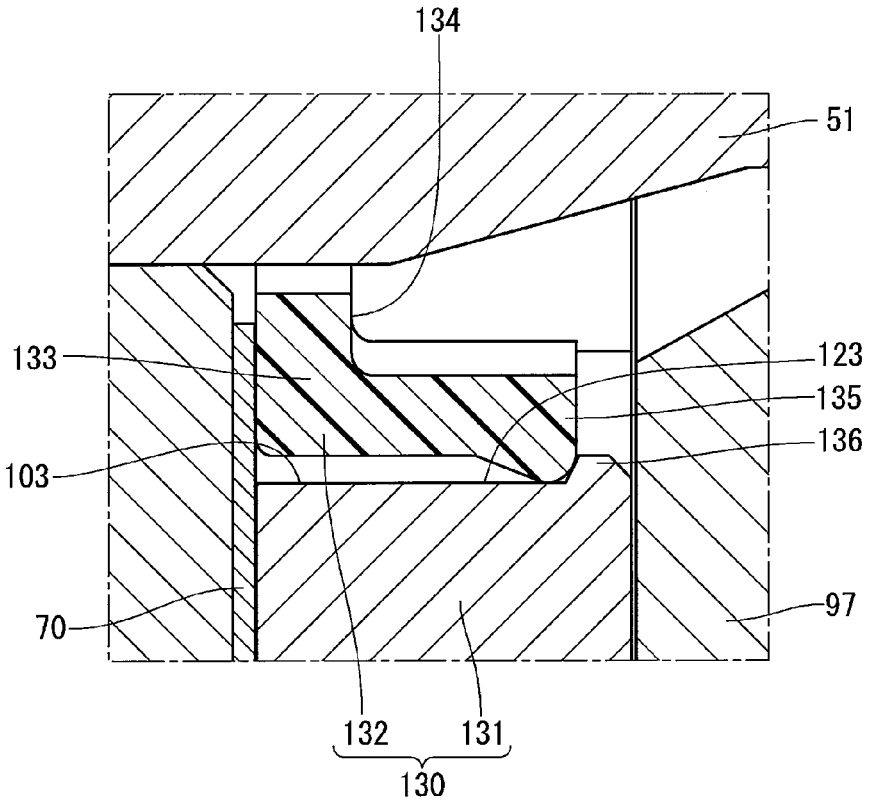
FIG. 14 is an enlarged view illustrating a part XIV in FIG. 12.

A valve timing adjusting device in a fourth embodiment will be described with reference to FIGS. 12 to 14. A characteristic configuration of the device of the fourth embodiment will be described below. In the fourth embodiment, as illustrated in FIGS. 12 and 13, a bushing 130 includes a base member 131 and a resin formation member 132. As illustrated in FIGS. 12 to 14, recessed parts 134 are formed between two filter parts 111 on a cam shaft 97-side wall portion of a fitting part 133 of the resin formation member 132. This recessed part 134 includes a pawl 135 that projects toward the cam shaft 97 from a bottom surface of the recessed part 134 and that is radially inwardly resiliently deformable.

Radially inwardly projecting engagement protrusions 136 are formed between two radial grooves 105 at a rim part of a fitting recessed part 123 of the base member 131. This engagement protrusion 136 is engaged with the pawl 135 to prevent the movement of the resin formation member 132 in its separating direction. The pawl 135 and the engagement protrusion 136 serve as a restricting means for restricting the separation of the resin formation member 132.

Effects of the fourth embodiment will be described below. As described above, in the fourth embodiment, the fitting part 133 of the resin formation member 132 includes the pawl 135 that is radially inwardly resiliently deformable. The base member 131 includes the engagement protrusion 136 which is engaged with the pawl 135 to prevent the movement of the resin formation member 132 in its separating direction. Accordingly, the resin formation member 132 is fixable to the base member 131. Moreover, a fixing member for fixing the resin formation member 132 to the base member 131 does not need to be separately provided.

(Fifth Embodiment)

Figure 15:
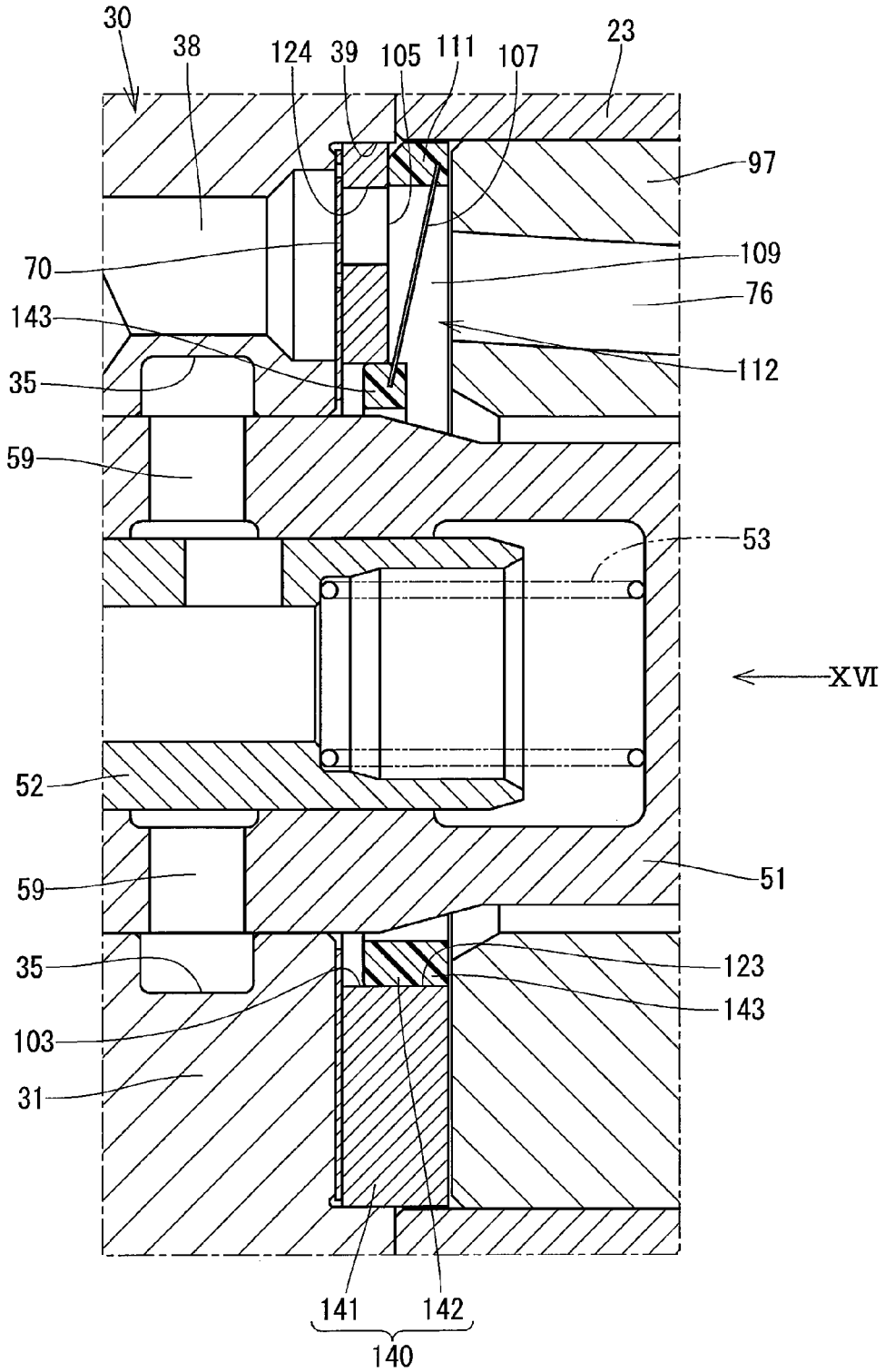
FIG. 15 is a sectional view illustrating a bushing and a filter of a valve timing adjusting device in accordance with a fifth embodiment and corresponding to FIG. 4 in the first embodiment.
Figure 16:
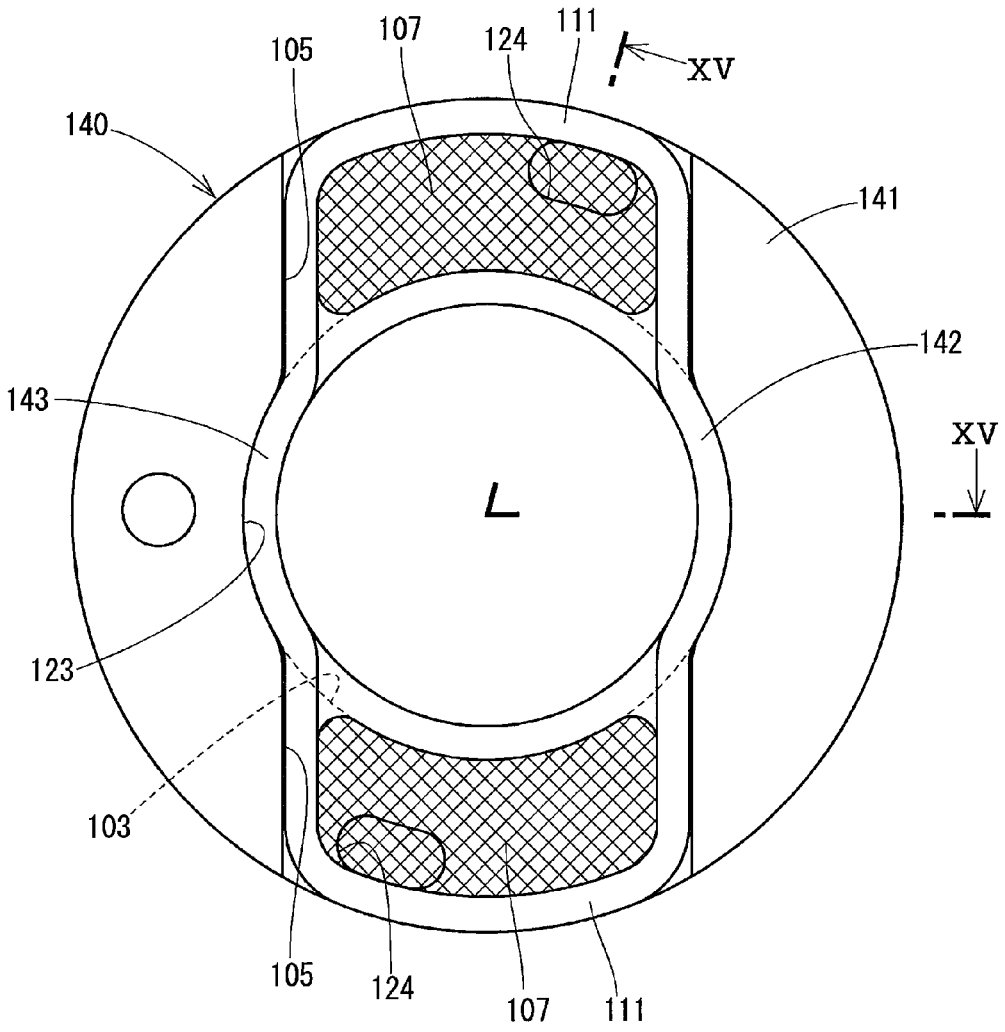
FIG. 16 is a diagram illustrating the bushing and the filter in FIG. 15 viewed from a direction of an arrow XVI.

A valve timing adjusting device in a fifth embodiment will be described in reference to FIGS. 15 and 16. A characteristic configuration of the device of the fifth embodiment will be described below. In the fifth embodiment, as illustrated in FIGS. 15 and 16, a bushing 140 includes a base member 141 and a resin formation member 142.

The base member 141 is configured similarly to the base member 121 of the third embodiment except for the absence of the crimped projection 127. The resin formation member 142 is fixed by press-fitting an outer peripheral surface of a fitting part 143 into a fitting recessed part 123 of the base member 141.

Effects of the fifth embodiment will be described below. As described above, in the fifth embodiment, the outer peripheral surface of the fitting part 143 of the resin formation member 142 is press-fitted into the fitting recessed part 123 of the base member 141. Accordingly, the resin formation member 142 is fixable to the base member 141. Moreover, a fixing member for fixing the resin formation member 142 to the base member 141 does not need to be separately provided.

Modifications of the above embodiments will be described below. In a modification, the vane rotor-side annular plate of the two annular plates constituting the bushing may be press-fitted in the camshaft-side annular plate, and the camshaft-side annular plate may be press-fitted in the vane rotor. In a modification, the two annular plates constituting the bushing may be integrally fixed by other methods than press-fitting, for example, use of a dedicated fastening tool. In a modification, the bushing may be made up of one annular plate, and the filter may be fixed in the through hole of the annular plate.

In a modification, the base member and the formation member constituting the bushing may be integrally fixed by, for example, use of a dedicated fastening tool. In a modification, the formation member and the filter constituting the bushing may be configured from the same material. For example, the formation member and the filter may be made of metal, and the filter may be made by creating holes by, for example, edging or laser processing at its portion having a relatively small thickness. In a modification, the filter may be made not only from metal but also from resin, for example. In a modification, the valve timing adjusting device may be for adjusting the valve timing of the exhaust valve of the engine. In a modification, the housing and the cam shaft may be provided to be integrally rotatable, and the vane rotor and the crankshaft may be provided to be integrally rotatable. The present disclosure is not limited to the above-described embodiments, and can be embodied in various modes without departing from the scope of the disclosure.

To sum up, the valve timing adjusting device 10 of the above embodiments can be described as follows.

A valve timing adjusting device is adapted to be provided on a drive force transmission route from a driving shaft 92 to a driven shaft 97 of an engine 90. The valve timing adjusting device 10 adjusts valve timing of a valve 91 which is opened or closed by the driven shaft 97, and includes a housing 20, a vane rotor 30, a direction switching valve 50, a check valve 70, a fixing unit 60, 100, 120, 130, 140, and a filter 84, 107. The housing 20 is rotatable integrally with a first shaft which is one of the driving shaft 92 and the driven shaft 97. The vane rotor 30 is rotatable integrally with a second shaft which is the other one of the driving shaft 92 and the driven shaft 97, and defines an advance chamber 41 and a retard chamber 42 between the vane rotor 30 and the housing 20. The vane rotor 30 includes a second supply oil passage 38 connectable to a first supply oil passage 76 of the second shaft. The direction switching valve 50 is provided at a central part of the vane rotor 30. The direction switching valve 50 connects together the second supply oil passage 38 and the advance chamber 41 at time of rotation of the vane rotor 30 toward an advance side relative to the housing 20, and connects together the second supply oil passage 38 and the retard chamber 42 at time of rotation of the vane rotor 30 toward a retard side relative to the housing 20. The check valve 70 is provided between the vane rotor 30 and the second shaft, and permits a flow in a direction from the first supply oil passage 76 toward the second supply oil passage 38 and prevents a flow in a direction from the second supply oil passage 38 toward the first supply oil passage 76. The fixing unit 60, 100, 120, 130, 140 is provided between the check valve 70 and the second shaft, and fixes the check valve 70 between the fixing unit 60, 100, 120, 130, 140 and the vane rotor 30. The fixing unit 60, 100, 120, 130, 140 includes a third supply oil passage 61, 112 which connects together the first supply oil passage 76 and the second supply oil passage 38. The filter 84, 107 is provided for the fixing unit 60, 100, 120, 130, 140 and is capable of capturing foreign substances flowing through the third supply oil passage 61, 112.

In the valve timing adjusting device 10 having the above-described configuration, the operating oil supplied from the first supply oil passage 76 of the second shaft is supplied into the advance chamber 41 and the retard chamber 42 through the third supply oil passage 61, 112 of the fixing unit 60, 100, 120, 130, 140, the check valve 70, the second supply oil passage 38 of the vane rotor 30, and the direction switching valve 50 in this order. The filter 84, 107 is provided on an upstream side of the advance chamber 41, the retard chamber 42, the direction switching valve 50, and the check valve 70. Accordingly, there can be limited the entry of external foreign substances into the advance chamber 41, the retard chamber 42, the direction switching valve 50, and the check valve 70.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A valve timing adjusting device adapted to be provided on a drive force transmission route from a driving shaft to a driven shaft of an engine, the valve timing adjusting device adjusting valve timing of a valve which is opened or closed by the driven shaft, and comprising:

a housing that is rotatable integrally with a first shaft which is one of the driving shaft and the driven shaft;

a vane rotor that is rotatable integrally with a second shaft which is the other one of the driving shaft and the driven shaft and that defines an advance chamber and a retard chamber between the vane rotor and the housing, the vane rotor including second supply oil passage connectable to a first supply oil passage of the second shaft;

a direction switching valve that is provided at a central part of the vane rotor, wherein the direction switching valve connects together the second supply oil passage and the advance chamber at time of rotation of the vane rotor toward an advance side relative to the housing, and connects together the second supply oil passage and the retard chamber at time of rotation of the vane rotor toward a retard side relative to the housing;

a check valve that is provided between the vane rotor and the second shaft and that permits a flow in a direction from the first supply oil passage toward the second supply oil passage and prevents a flow in a direction from the second supply oil passage toward the first supply oil passage;

a fixing unit that is provided between the check valve and the second shaft and fixes the check valve between the fixing unit and the vane rotor, the fixing unit including a third supply oil passage which connects together the first supply oil passage and the second supply oil passage; and a filter that is provided for the fixing unit and is configured to capture foreign substances flowing through the third supply oil passage; wherein the check valve is in contact with the vane rotor.

2. The valve timing adjusting device according to claim 1, wherein:

the fixing unit includes a first plate and a second plate;

the check valve is clamped between the first plate and the vane rotor; and the filter is clamped between the second plate and the first plate.

3. The valve timing adjusting device according to claim 2, wherein:

the first plate includes:

a first circumferential groove that extends in a circumferential direction of the first plate along a wall portion of the first plate; and a first through hole that passes through a part of a bottom wall of the first circumferential groove to communicate with the second supply oil passage;

the second plate includes:

a second circumferential groove that extend in a circumferential direction of the second plate along a wall portion of the second plate; and a second through hole that passes through a part of a bottom wall of the second circumferential groove to communicate with the first supply oil passage; and the third supply oil passage includes the first through hole, the first circumferential groove, the second circumferential groove, and the second through hole.

4. The valve timing adjusting device according to claim 3, wherein the first through hole is located at a different position from the second through hole in the circumferential direction.

5. The valve timing adjusting device according to claim 2, wherein one of the first plate and the second plate is fixed to the other one of the first plate and the second plate by being press-fitted into a fitting hole of the other one of the first plate and the second plate.

6. The valve timing adjusting device according to claim 1, wherein:

the fixing unit includes a base member and a formation member;

the check valve is fixed between the base member and the vane rotor;

the formation member is provided between the base member and the second shaft;

the filter is inserted in the formation member; and at least one of an axial distance of an axial clearance defined by the formation member with respect to the base member or the second shaft, and a radial distance of a radial clearance defined by the formation member with respect to the base member or the second shaft is equal to or smaller than a mesh size of the filter.

7. The valve timing adjusting device according to claim 6, wherein the formation member includes:

an annular fitting part that is fitted in a fitting recessed part of the base member; and a filter part that projects radially outward of the fitting part and is formed in a shape of a frame to define therein a space that constitutes the third supply oil passage, the filter being inserted in the filter part to cover the space.

8. The valve timing adjusting device according to claim 7, wherein the fitting part of the formation member includes a plurality of press-fit protrusions that project radially outward and that are press-fitted in the fitting recessed part.

9. The valve timing adjusting device according to claim 7, wherein the base member includes a crimped projection that is formed by crimping a rim of the fitting recessed part and that is engaged with the fitting part to prevent a displacement of the formation member in a direction in which the formation member is separated.

10. The valve timing adjusting device according to claim 7, wherein:

the fitting part of the formation member includes a pawl that is radially inwardly resiliently deformable; and the base member includes an engagement protrusion that is engaged with the pawl to prevent a displacement of the formation member in a direction in which the formation member is separated.

11. The valve timing adjusting device according to claim 7, wherein an outer peripheral surface of the fitting part of the formation member is press-fitted into the fitting recessed part.

12. The valve timing adjusting device according to claim 1, wherein a total opening area of the filter in the third supply oil passage is larger than a passage sectional area of the narrowest part of the first supply oil passage, the second supply oil passage, and the third supply oil passage.

13. A valve timing adjusting device adapted to be provided on a drive force transmission route from a driving shaft to a driven shaft of an engine, the valve timing adjusting device adjusting valve timing of a valve which is opened or closed by the driven shaft, and comprising:

a housing that is rotatable integrally with a first shaft which is one of the driving shaft and the driven shaft;

a vane rotor that is rotatable integrally with a second shaft which is the other one of the driving shaft and the driven shaft and that defines an advance chamber and a retard chamber between the vane rotor and the housing, the vane rotor including a second supply oil passage connectable to a first supply oil passage of the second shaft;

a direction switching valve that is provided at a central part of the vane rotor, wherein the direction switching valve connects together the second supply oil passage and the advance chamber at time of rotation of the vane rotor toward an advance side relative to the housing, and connects together the second supply oil passage and the retard chamber at time of rotation of the vane rotor toward a retard side relative to the housing;

a check valve that is provided between the vane rotor and the second shaft and that permits a flow in a direction from the first supply oil passage toward the second supply oil passage and prevents a flow in a direction from the second supply oil passage toward the first supply oil passage;

a bushing that is provided between the check valve and the second shaft and fixes the check valve between the bushing and the vane rotor, the bushing including a third supply oil passage which connects together the first supply oil passage and the second supply oil passage; and a filter that is provided for the bushing and is configured to capture foreign substances flowing through the third supply oil passage; wherein the check valve is in contact with the vane rotor.

* * * * *